US010060671B2

(12) United States Patent
Ducote, Jr. et al.

(10) Patent No.: US 10,060,671 B2
(45) Date of Patent: Aug. 28, 2018

(54) MIXED REFRIGERANT LIQUEFACTION SYSTEM AND METHOD

(71) Applicant: Chart Energy & Chemicals, Inc., The Woodlands, TX (US)

(72) Inventors: Douglas A. Ducote, Jr., The Woodlands, TX (US); Timothy P. Gushanas, Pearland, TX (US); Mark R. Glanville, The Woodlands, TX (US)

(73) Assignee: Chart Energy & Chemicals, Inc., Ball Ground, GA (US)

( * ) Notice: Subject to any disclaimer, the term of this patent is extended or adjusted under 35 U.S.C. 154(b) by 0 days.

(21) Appl. No.: 15/095,631

(22) Filed: Apr. 11, 2016

(65) Prior Publication Data

US 2016/0298898 A1 Oct. 13, 2016

Related U.S. Application Data

(60) Provisional application No. 62/145,929, filed on Apr. 10, 2015, provisional application No. 62/215,511, filed on Sep. 8, 2015.

(51) Int. Cl.
*F25J 1/00* (2006.01)
*F25J 1/02* (2006.01)

(52) U.S. Cl.
CPC ..... *F25J 1/0022* (2013.01); *F25J 1/004* (2013.01); *F25J 1/0035* (2013.01); *F25J 1/0042* (2013.01);
(Continued)

(58) Field of Classification Search
CPC .. F25J 1/004; F25J 1/0022; F25J 1/023; F25J 1/0042; F25J 1/0055; F25J 1/0057;
(Continued)

(56) References Cited

U.S. PATENT DOCUMENTS 5,893,274 A * 4/1999 Nagelvoort ..... F25J 1/0022 62/613
6,272,882 B1 * 8/2001 Hodges ..... F25J 1/0022 62/613
(Continued)

OTHER PUBLICATIONS

International Search Report and Written Opinion of the International Searching Authority, PCT/US2016/026924, dated Aug. 19, 2016.

*Primary Examiner* — Keith Raymond
*Assistant Examiner* — Webeshet Mengesha
(74) *Attorney, Agent, or Firm* — Cook Alex Ltd.; R. Blake Johnston

(57) ABSTRACT

A system for liquefying a gas includes a liquefaction heat exchanger having a feed gas inlet adapted to receive a feed gas and a liquefied gas outlet through which the liquefied gas exits after the gas is liquefied in the liquefying passage of the heat exchanger by heat exchange with a primary refrigeration passage. A mixed refrigerant compressor system is configured to provide refrigerant to the primary refrigeration passage. An expander separator is in communication with the liquefied gas outlet of the liquefaction heat exchanger, and a cold gas line is in fluid communication with the expander separator. A cold recovery heat exchanger receives cold vapor from the cold gas line and liquid refrigerant from the mixed refrigerant compressor system so that the refrigerant is cooled using the cold vapor.

15 Claims, 9 Drawing Sheets

(52) U.S. Cl.
CPC ..... *F25J 1/0055* (2013.01); *F25J 1/0057* (2013.01); *F25J 1/023* (2013.01); *F25J 1/0219* (2013.01); *F25J 1/0238* (2013.01); *F25J 1/0262* (2013.01); *F25J 1/0267* (2013.01); *F25J 1/0279* (2013.01); *F25J 1/0283* (2013.01); *F25J 1/0294* (2013.01); *F25J 2210/04* (2013.01); *F25J 2220/64* (2013.01); *F25J 2230/08* (2013.01); *F25J 2230/24* (2013.01); *F25J 2230/30* (2013.01); *F25J 2230/60* (2013.01); *F25J 2245/02* (2013.01); *F25J 2245/90* (2013.01)

(58) Field of Classification Search
CPC ..... F25J 1/0238; F25J 1/0262; F25J 1/0035; F25J 1/0267; F25J 1/0279; F25J 1/0211–1/0219; F25J 2270/12; F25J 2270/66
See application file for complete search history.

(56) References Cited

U.S. PATENT DOCUMENTS

| | | | | |
|---|---|---|---|---|
| 2008/0016910 | A1 | 1/2008 | Brostow et al. | |
| 2011/0226008 | A1 | 9/2011 | Gushanas et al. | |
| 2012/0047943 | A1 | 3/2012 | Barclay et al. | |
| 2013/0174603 | A1* | 7/2013 | Roberts ..... | F25J 1/0022 62/611 |
| 2013/0213087 | A1 | 8/2013 | Currence et al. | |
| 2015/0184930 | A1* | 7/2015 | Bonnissel ..... | F25J 1/0022 62/611 |

* cited by examiner

MIXED REFRIGERANT LIQUEFACTION SYSTEM AND METHOD

CLAIM OF PRIORITY

This application claims the benefit of U.S. Provisional Application No. 62/145,929, filed Apr. 10, 2015, and U.S. Provisional Application No. 62/215,511, filed Sep. 8, 2015, the contents of each of which are hereby incorporated by reference.

FIELD OF THE DISCLOSURE

The present invention relates generally to systems and methods for cooling or liquefying gases and, more particularly, to a mixed refrigerant liquefaction system and method.

SUMMARY OF THE DISCLOSURE

There are several aspects of the present subject matter which may be embodied separately or together in the methods, devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect, a system is provided for liquefying a gas and includes a liquefaction heat exchanger having a warm end including a feed gas inlet and a cold end including a liquefied gas outlet with a liquefying passage positioned therebetween. The feed gas inlet is adapted to receive a feed gas. The liquefaction heat exchanger also includes a primary refrigeration passage. A mixed refrigerant compressor system is configured to provide refrigerant to the primary refrigeration passage. An expander separator is in communication with the liquefied gas outlet of the liquefaction heat exchanger. A cold gas line is in fluid communication with the expander separator. A cold recovery heat exchanger has a vapor passage in communication with the cold gas line and a liquid passage, where the vapor passage is configured to receive cold vapor from the cold gas line. The mixed refrigerant compressor system includes a liquid refrigerant outlet in fluid communication with the liquid passage of the cold recovery heat exchanger. The cold recovery heat exchanger is configured to receive refrigerant in the liquid passage and cool refrigerant in the liquid passage using cold vapor in the vapor passage.

In another aspect, a process is provided for liquefying a gas and includes providing a gas feed to a liquefying heat exchanger that receives refrigerant from a mixed refrigerant compressor system. The gas is liquefied in the liquefying heat exchanger using refrigerant from the mixed refrigerant compressor system so that a liquid product is produced. At least a portion of the liquid product is expanded and separated into a vapor portion and a liquid portion. The vapor portion is directed to a cold recovery heat exchanger. Refrigerant is directed from the mixed refrigerant compressor system to the cold recovery heat exchanger. The refrigerant is cooled in the cold recovery heat exchanger using the vapor portion.

In yet another aspect, a system for liquefying a gas is provided and includes a liquefaction heat exchanger having a warm end and a cold end, a liquefying passage having an inlet at the warm end and an outlet at the cold end, a primary refrigeration passage, and a high pressure refrigerant liquid passage. A mixed refrigerant compressor system is in communication with the primary refrigeration passage and the high pressure refrigerant liquid passage. A refrigerant expander separator has an inlet in communication with the high pressure mixed refrigerant liquid passage, a liquid outlet in communication with the primary refrigeration passage and a vapor outlet in communication with the primary refrigeration passage.

In yet another aspect, a system for removing freezing components from a feed gas is provided and includes a heavy hydrocarbon removal heat exchanger having a feed gas cooling passage with an inlet adapted to communicate with a source of the feed gas, a return vapor passage and a reflux cooling passage. The system also includes a scrub device having a feed gas inlet in communication with an outlet of the feed gas cooling passage of the heat exchanger, a return vapor outlet in communication with an inlet of the return vapor passage of the heat exchanger, a reflux vapor outlet in communication with an inlet of the reflux cooling passage of the heat exchanger and a reflux mixed phase inlet in communication with an outlet of the reflux cooling passage of the heat exchanger. A reflux liquid component passage has an inlet and an outlet both in communication with the scrub device. The scrub device is configured to vaporize a reflux liquid component stream from the outlet of the reflux liquid component passage so as to cool a feed gas stream entering the scrub device through the feed gas inlet of the scrub device so that the freezing components are condensed and removed from the scrub device through a freezing components outlet. A processed feed gas line is in communication with an outlet of the vapor return passage of the heat exchanger.

In yet another aspect, a process for removing freezing components from a feed gas includes providing a heavy hydrocarbon removal heat exchanger and a scrub device. The feed gas is cooled using the heat exchanger to create a cooled feed gas stream. The cooled gas stream is directed to the scrub device. Vapor from the scrub device is directed to the heat exchanger and the vapor is cooled to create a mixed phase reflux stream. The mixed phase reflux stream is directed to the scrub device so that a liquid component reflux stream is provided for the scrub device. The liquid component reflux stream is vaporized in the scrub device so that the freezing components are condensed and removed from the cooled feed gas stream in the scrub device to create a processed feed gas vapor stream. The processed feed gas vapor stream is directed to the heat exchanger. The processed feed gas vapor stream is warmed in the heat exchanger to produce a warmed processed feed gas vapor stream suitable for liquefaction.

DETAILED DESCRIPTION OF EMBODIMENTS

Figure 1:
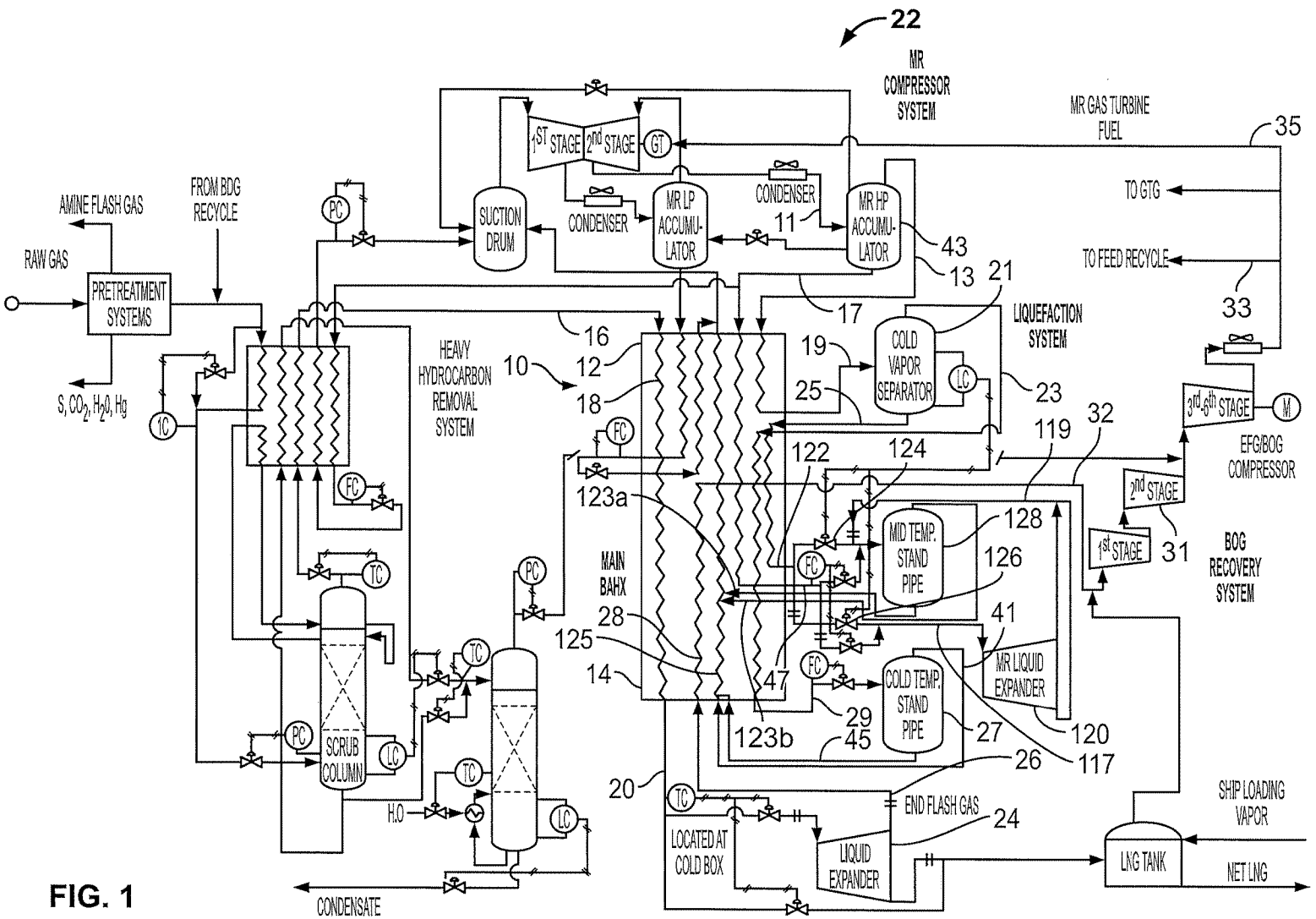
FIG. 1 is a process flow diagram and schematic illustrating a mixed refrigerant liquefaction system and method with a vapor/liquid separator in the liquefied gas stream at the cold end of the main heat exchanger where the cold end flash gas from the separator is directed to an additional refrigeration pass through the main heat exchanger.

Embodiments of a mixed refrigerant liquefaction system and method are illustrated in FIGS. 1-7. It should be noted that while the embodiments are illustrated and described below in terms of liquefying natural gas to produce liquid natural gas, the invention may be used to liquefy other types of gases.

The basic liquefaction process and mixed refrigerant compressor system may be as described in commonly owned U.S. Patent Application Publication No. 2011/0226008, U.S. patent application Ser. No. 12/726,142, to Gushanas et al., the contents of which are hereby incorporated by reference. Generally, with reference to FIG. 1, the system includes a multi-stream heat exchanger, indicated in general at 10, having a warm end 12 and a cold end 14. The heat exchanger receives a high pressure natural gas feed stream 16 that is liquefied in cooling or liquefying passage 18 via removal of heat via heat exchange with refrigeration streams in the heat exchanger. As a result, a stream 20 of liquid natural gas (LNG) product is produced. The multi-stream design of the heat exchanger allows for convenient and energy-efficient integration of several streams into a single exchanger. Suitable heat exchangers may be purchased from Chart Energy & Chemicals, Inc. of The Woodlands, Tex. The plate and fin multi-stream heat exchanger available from Chart Energy & Chemicals, Inc. offers the further advantage of being physically compact.

The system of FIG. 1, including heat exchanger 10, may be configured to perform other gas processing options known in the prior art. These processing options may require the gas stream to exit and reenter the heat exchanger one or more times and may include, for example, natural gas liquids recovery or nitrogen rejection.

The removal of heat is accomplished in the heat exchanger using a mixed refrigerant, that is processed and reconditioned using a mixed refrigerant compressor system indicated in general at 22. The mixed refrigerant compressor system includes a high pressure accumulator 43 that receives and separates a mixed refrigerant (MR) mixed-phase stream 11 after a last compression and cooling cycle. While an accumulator drum 43 is illustrated, alternative separation devices may be used, including, but not limited to, another type of vessel, a cyclonic separator, a distillation unit, a coalescing separator or mesh or vane type mist eliminator. High pressure vapor refrigerant stream 13 exits the vapor outlet of the accumulator 43 and travels to the warm side of the heat exchanger 10.

High pressure liquid refrigerant stream 17 exits the liquid outlet of accumulator 43 and also travels to the warm end of the heat exchanger. After cooling in the heat exchanger 10, it travels as mixed phase stream 47 to mid-temp stand pipe 128.

After the high pressure vapor stream 13 from the accumulator 43 is cooled in the heat exchanger 10, mixed phase stream 19 flows to cold vapor separator 21. A resulting vapor refrigerant stream 23 exits the vapor outlet of the separator 21 and, after cooling in the heat exchanger 10, travels to cold temperature stand pipe 27 as mixed-phase stream 29. Vapor and liquid streams 41 and 45 exit the cold temperature stand pipe 27 and feed into the primary refrigeration passage 125 on the cold side of the heat exchanger 10.

The liquid stream 25 exiting the cold vapor separator 21 is cooled in heat exchanger 10 and exits the heat exchanger as mixed phase stream 122, which is handled in the manner described below.

The systems of FIGS. 2-7 feature components similar to those described above.

The system shown in FIG. 1 utilizes an expander separator 24, which may be liquid expander with integrated vapor/liquid separator or, alternatively, a liquid expander in series with any vapor/liquid separation device, to extract energy from the high pressure LNG stream 20, as pressure is reduced. This results in reduced LNG temperature and resulting end flash gas (EFG); thereby, providing improved LNG production for the same MR power and improved energy consumption per tonne of LNG produced. The cold end flash gas, resulting from the liquid expansion, exits the vapor/liquid separator 24 as stream 26 and is sent to the main liquefaction heat exchanger 10 at the cold end and is integrated with the heat exchanger by incorporating an additional refrigeration passage 28, such that it contributes to the overall refrigeration requirements for liquefaction, thereby further improving LNG production for the same MR power without adding significant capital cost to the main heat exchanger 10. As an example only, the EFG stream 26 may have a temperature and pressure of −254° F. and 19 psia.

In the system of FIG. 1, the EFG refrigeration is either totally recovered in the heat exchanger 10 or may be partially recovered as best fits the equipment and process design. The warmed end flash gas exits the heat exchanger as stream 32 and, after optional compression via compressor(s) 31, can be recycled to the plant feed gas 33, used as gas turbine/plant fuel 35 or disposed in any other acceptable manner. The LNG liquid expander can be used either with or without the mid-temperature liquid expander described below with reference to FIG. 1A.

Figure 2:
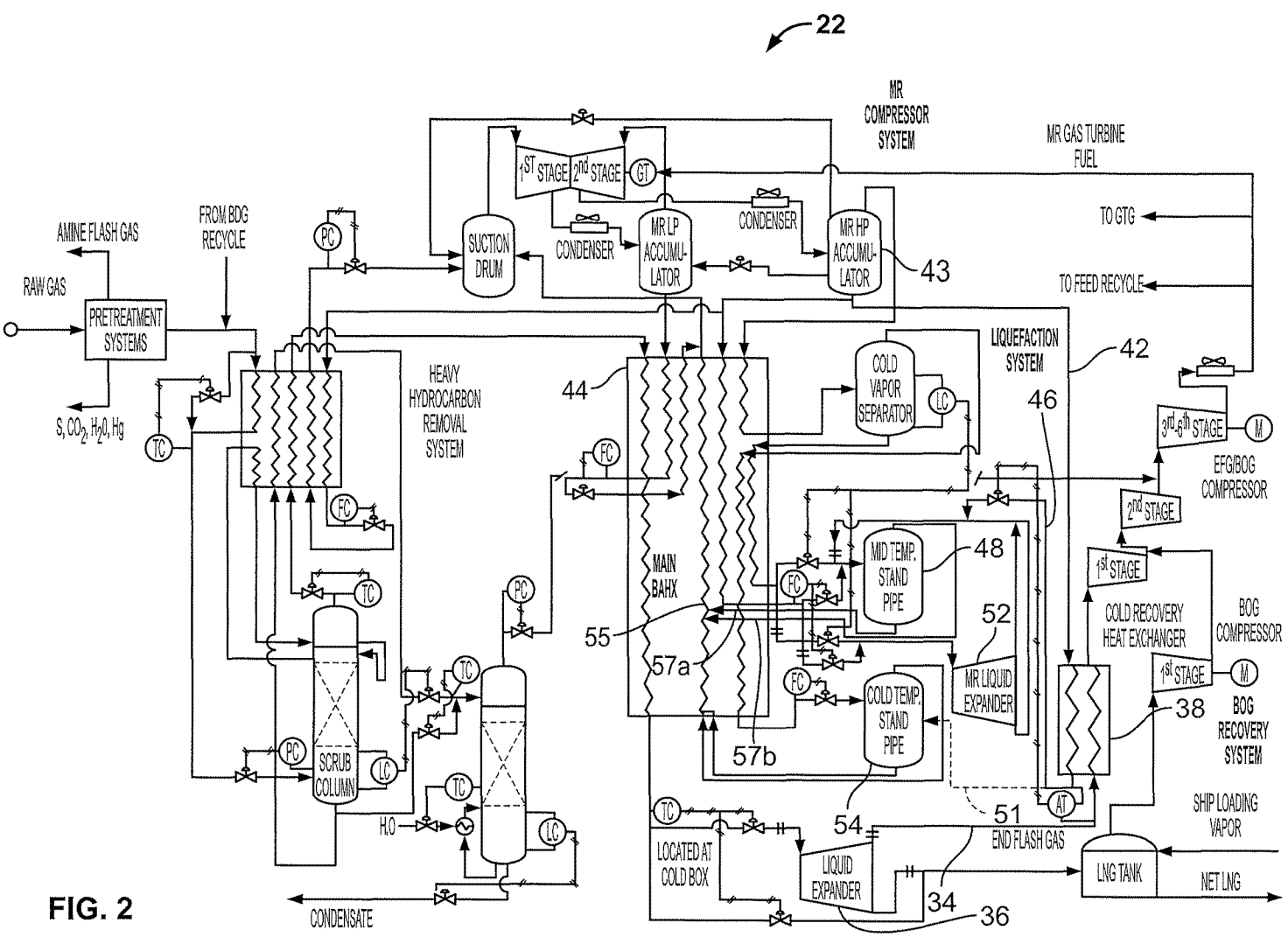
FIG. 2 is a process flow diagram and schematic illustrating a mixed refrigerant liquefaction system and method with a vapor/liquid separator in the liquefied gas stream at the cold end of the main heat exchanger where the cold end flash gas from the separator is directed to a cold recovery heat exchanger for cooling the mixed refrigerant.

The system of FIG. 2 features an option to the EFG cold recovery configuration shown in FIG. 1. In this option, the EFG cold refrigeration stream 34 from the vapor/liquid separator 36 is directed to a cold recovery heat exchanger 38 where it is heat exchanged by with a warm high pressure mixed refrigerant (MR) stream, or streams 42 from a high pressure accumulator 43 of the MR compressor system 22. The high pressure MR stream 42 is cooled using the EFG from stream 34, then returned to a refrigeration passage 55 of the liquefying heat exchanger 44 via line 46 and the mid-standpipe (middle temperature standpipe) 48 (as shown by line 49 in FIG. 3) or, alternatively, a mid-temperature liquid expander 52 (as shown by line 46 in FIG. 2) or a cold standpipe 54 (as shown in phantom by line 51 in FIG. 2). Once the cooled high pressure MR stream from the cold recovery heat exchanger 38 is received by the mid-standpipe 48 or the mid-temperature liquid expander separator 52, it is delivered to the refrigeration passage 55 of the liquefying heat exchanger 44 by lines 57*a* and 57*b* (of FIG. 2).

As an example only, the EFG stream 34 of FIG. 2 may have a temperature and pressure of −252° F. and 30 psia.

Figure 2A:
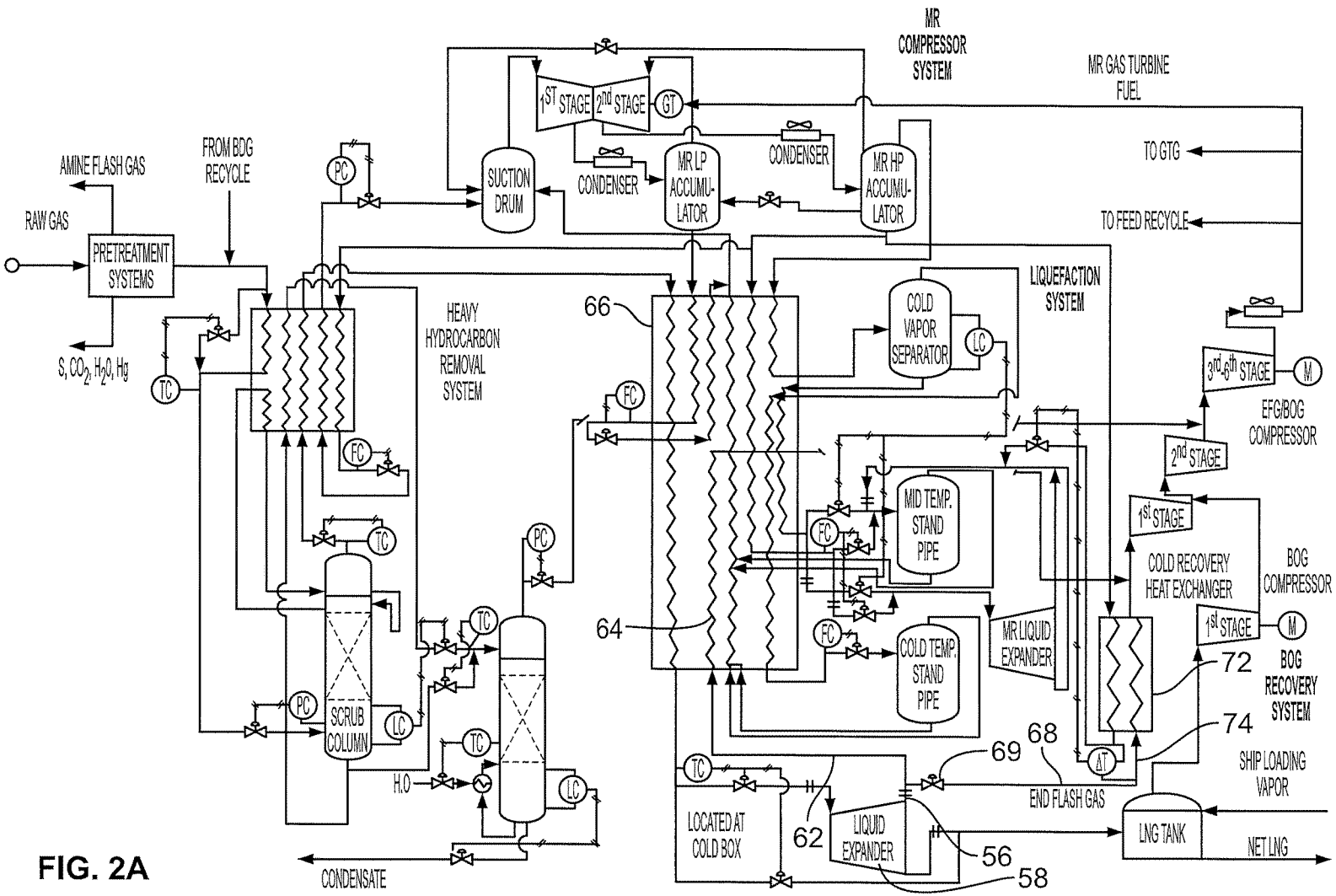
FIG. 2A is a process flow diagram and schematic illustrating a mixed refrigerant liquefaction system and method with a vapor/liquid separator in the liquefied gas stream at the cold end of the main heat exchanger where the cold end flash gas from the separator is directed to an additional refrigeration pass through the main heat exchanger and a cold recovery heat exchanger for cooling the mixed refrigerant.

The EFG cold recovery options of FIGS. 1 and 2 can be combined as illustrated in FIG. 2A. More specifically, the EFG stream 56 exiting the vapor/liquid separator 58 is split to form stream 62, which leads to the refrigeration passage 64 of the main heat exchanger 66, and stream 68, which leads to the cold recovery heat exchanger 72 to refrigerate the MR stream(s) 74 flowing through the cold recovery heat exchanger 72 as described above for the system of FIG. 2. As a result, the EFG cold is recovered in both the main heat exchanger 66 and the cold recovery heat exchanger 72, in the optimum proportions to fit the equipment and the process. The portions of EFG stream 56 flowing to stream 62 and stream 68 may be controlled by valve 69.

Figure 3:
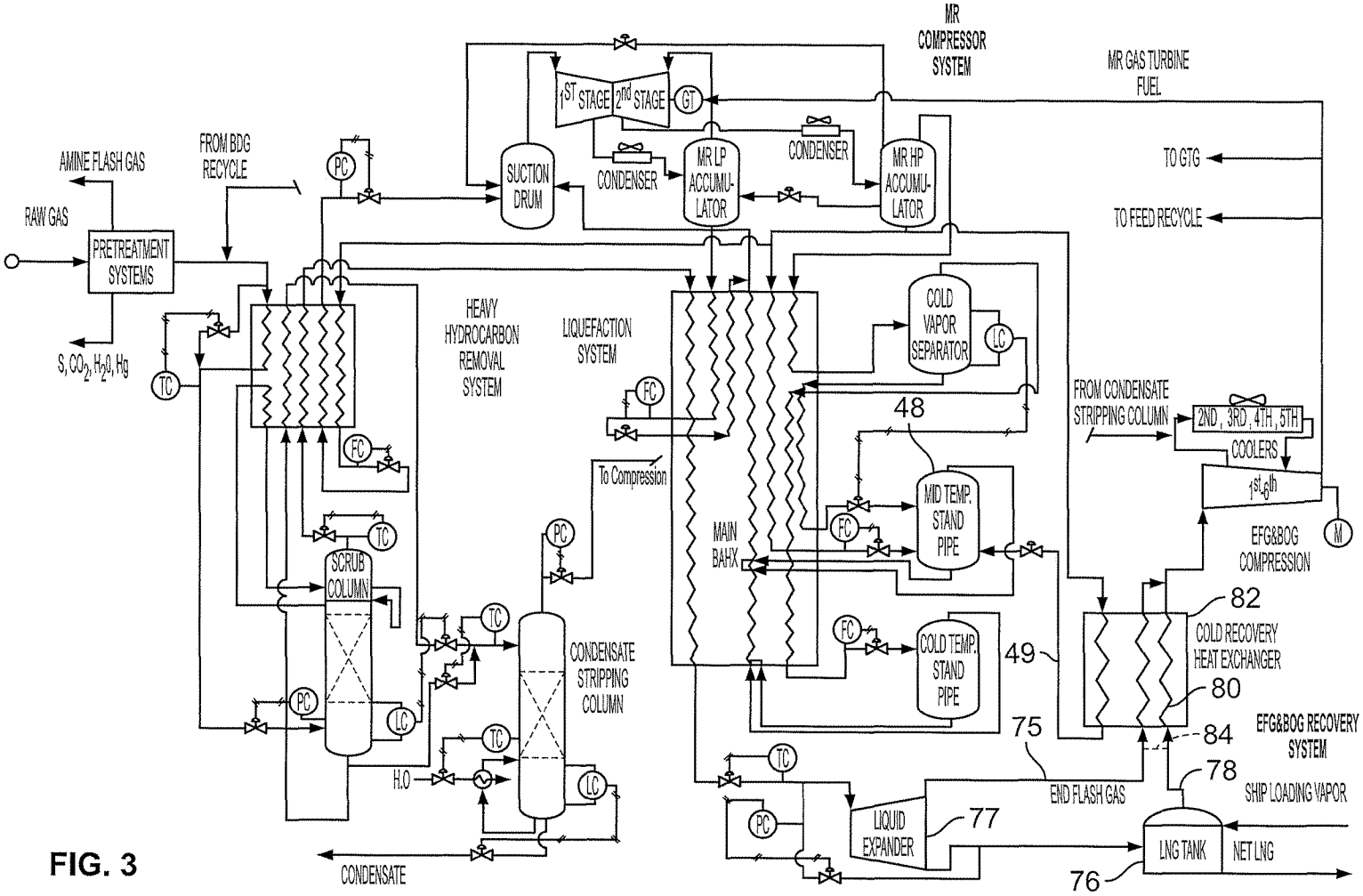
FIG. 3 is a process flow diagram and schematic illustrating a mixed refrigerant liquefaction system and method with a vapor/liquid separator in the liquefied gas stream at the cold end of the main heat exchanger where the cold end flash gas from the separator is directed to a cold recovery heat exchanger for cooling the mixed refrigerant, where the cold recovery heat exchanger also receives boil-off gas form the product storage tanks.

The system of FIG. 3 shows another option for cold recovery of both the EFG stream 75 from the vapor/liquid separator 77 and Boil-Off Gas (BOG) from the LNG product storage tank(s) 76 and other sources. In this configuration, a stream of BOG 78 exits the storage tank(s) 76 and travels to a BOG cold recovery passage 80 provided in the cold recovery heat exchanger 82. Alternatively, the cold recovery heat exchanger 82 may feature a single, shared EFG and BOG passage with the EFG and BOG streams 75 and 78 combined prior to entering the cold recovery heat exchanger 82, as indicated in phantom at 84 in FIG. 3. In either case, high pressure MR is cooled by the EFG and BOG and used as refrigeration as mentioned above.

Figure 4:
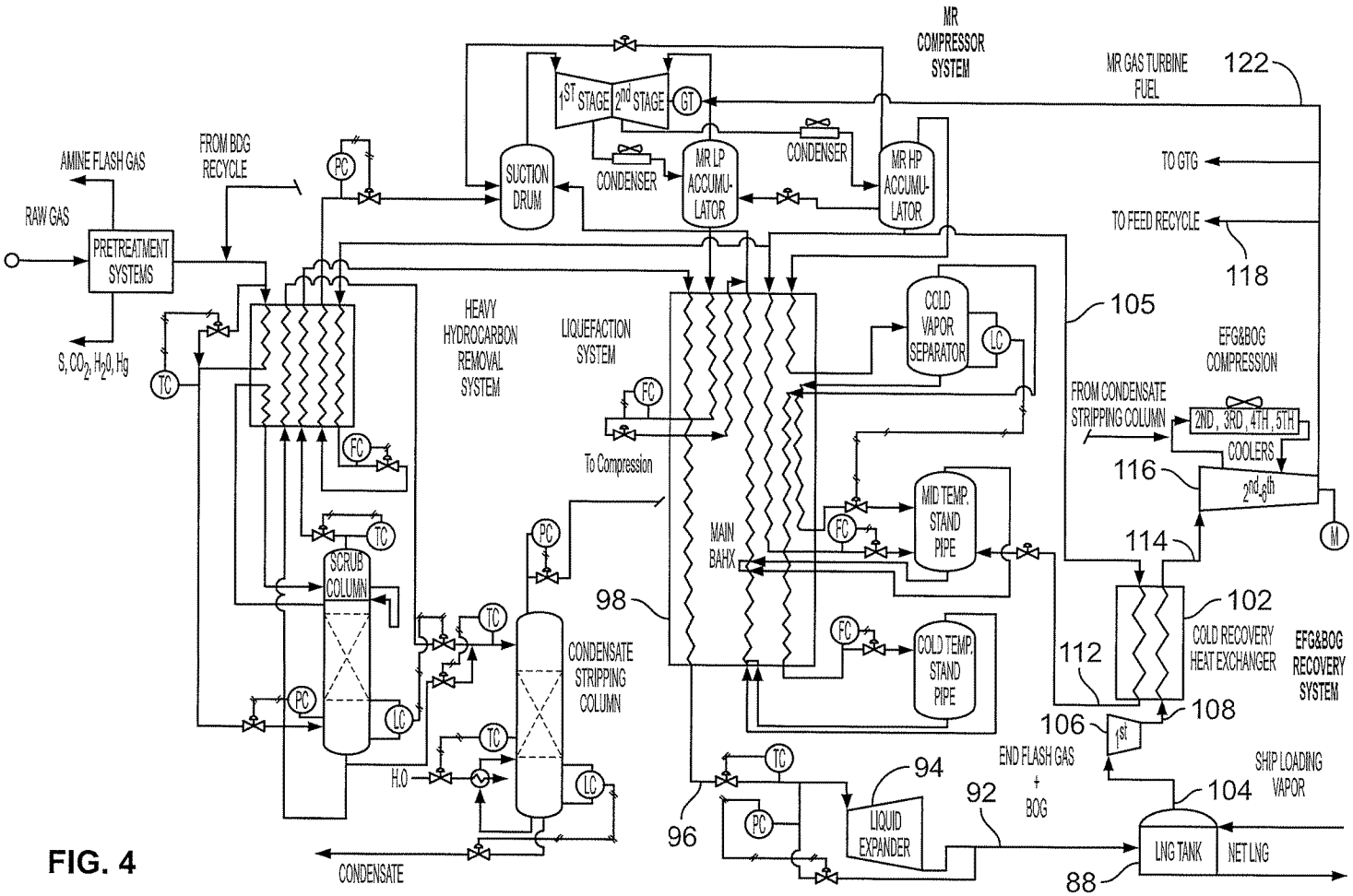
FIG. 4 is a process flow diagram and schematic illustrating a mixed refrigerant liquefaction system and method where the liquefied gas stream at the cold end of the main heat exchanger is directed to a storage tank where end flash gas is separated from the liquid product and the end flash gas and boil-off gas from the storage tank are compressed and directed to a cold recovery heat exchanger for cooling the mixed refrigerant.

In alternative embodiments, with reference to FIG. 4, the system may use the LNG product storage tank 88 as the vapor/liquid separator to obtain the EFG from the liquid product stream 92 that exits a liquid expander 94. It should be noted that a Joule-Thomson (JT) valve may be substituted for the liquid expander 94 to cool the stream. As is clear from the above descriptions, the liquid expander 94 receives the liquid product stream 96 from the main heat exchanger 98. As a result, the system of FIG. 4 provides for cold recovery of both EFG and BOG wherein the EFG is separated from the LNG in the LNG storage tank and both the EFG and BOG are directed to the cold recovery heat exchanger 102 via stream 104. As a result, a high pressure MR stream 105 flowing to the cold recovery heat exchanger 102 is cooled by the EFG and BOG.

In the system of FIG. 4, the EFG and BOG stream 104 is directed to a compressor 106 where it is compressed to a 1$^{st}$ stage pressure. This pressure is selected to (1) provide a pressure and temperature for the stream 108 exiting the compressor suitable to allow higher pressure drop in the cold recovery heat exchanger 102 and reduce cost; and (2) be suitable to supply a temperature to the cold recovery heat exchanger that makes the exiting cold MR steam 112 useful as a refrigerant in the main heat exchanger 98. As an example only, the pressure and temperature of the MR stream exiting the compressor 106 could be −175° F. and 30 psia. The EFG and BOG stream 114 exiting the cold recovery heat exchanger 102 may be compressed via compressor 116 and used as feed recycle 118 or gas turbine/plant fuel 122 or disposed in any other acceptable manner.

Figure 5:
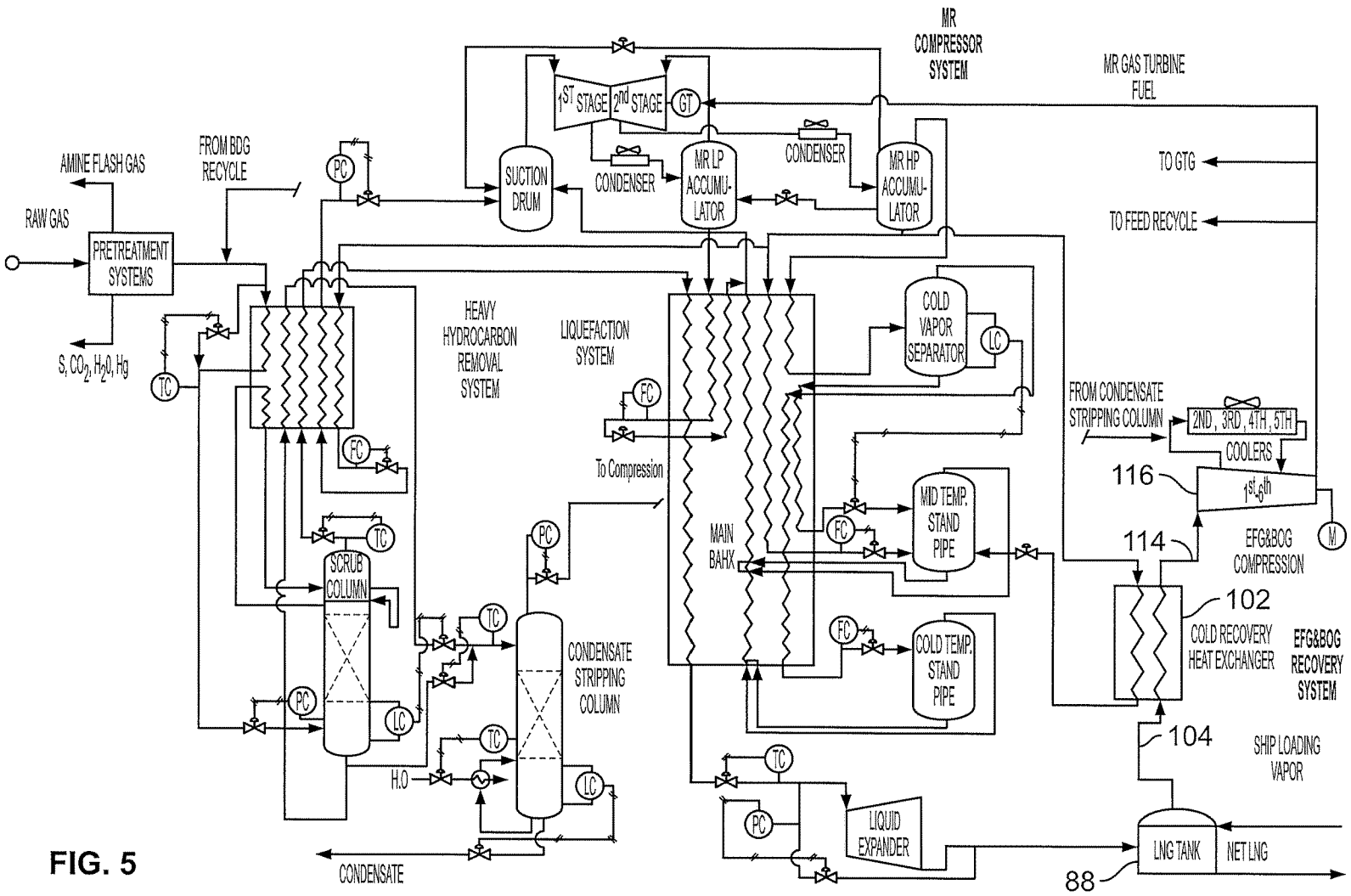
FIG. 5 is a process flow diagram and schematic illustrating a mixed refrigerant liquefaction system and method where the liquefied gas stream at the cold end of the main heat exchanger is directed to a storage tank where end flash gas is separated from the liquid product and the end flash gas and boil-off gas from the storage tank are directed to a cold recovery heat exchanger for cooling the mixed refrigerant.

As illustrated in FIG. 5, the pre-heat exchanger compressor 106 of FIG. 4 may be omitted so that the EFG and BOG stream 104 from LNG tank(s) 88 travels directly to cold recovery heat exchanger 102. As a result, only compression of the EFG and BOG stream 114 after the cold recovery heat exchanger occurs (via compressor 116). Otherwise, the system of FIG. 5 is identical to the system of FIG. 4.

Returning to FIG. 1, an optional liquid expander separator 120, which may be a liquid expander with integrated vapor/liquid separator or the two components in series, receives at least a portion of the high pressure mid-temperature MR refrigerant stream 122 through line 117. This liquid expander extracts work from the MR stream, reduces the temperature and provides additional refrigeration for LNG production after the MR fluid exiting the liquid expander travels through line 119 to the mid-temperature standpipe separator 128 and then joins the heat exchanger refrigeration stream 125 via streams 123*a* and 123*b* and improves cycle efficiency. The corresponding circuit features valves 124 and 126. With valve 126 at least partially open and valve 124 at least partially closed, the liquid expander 120 is used in series with the mid-temp stand pipe separator 128.

Figure 1A:
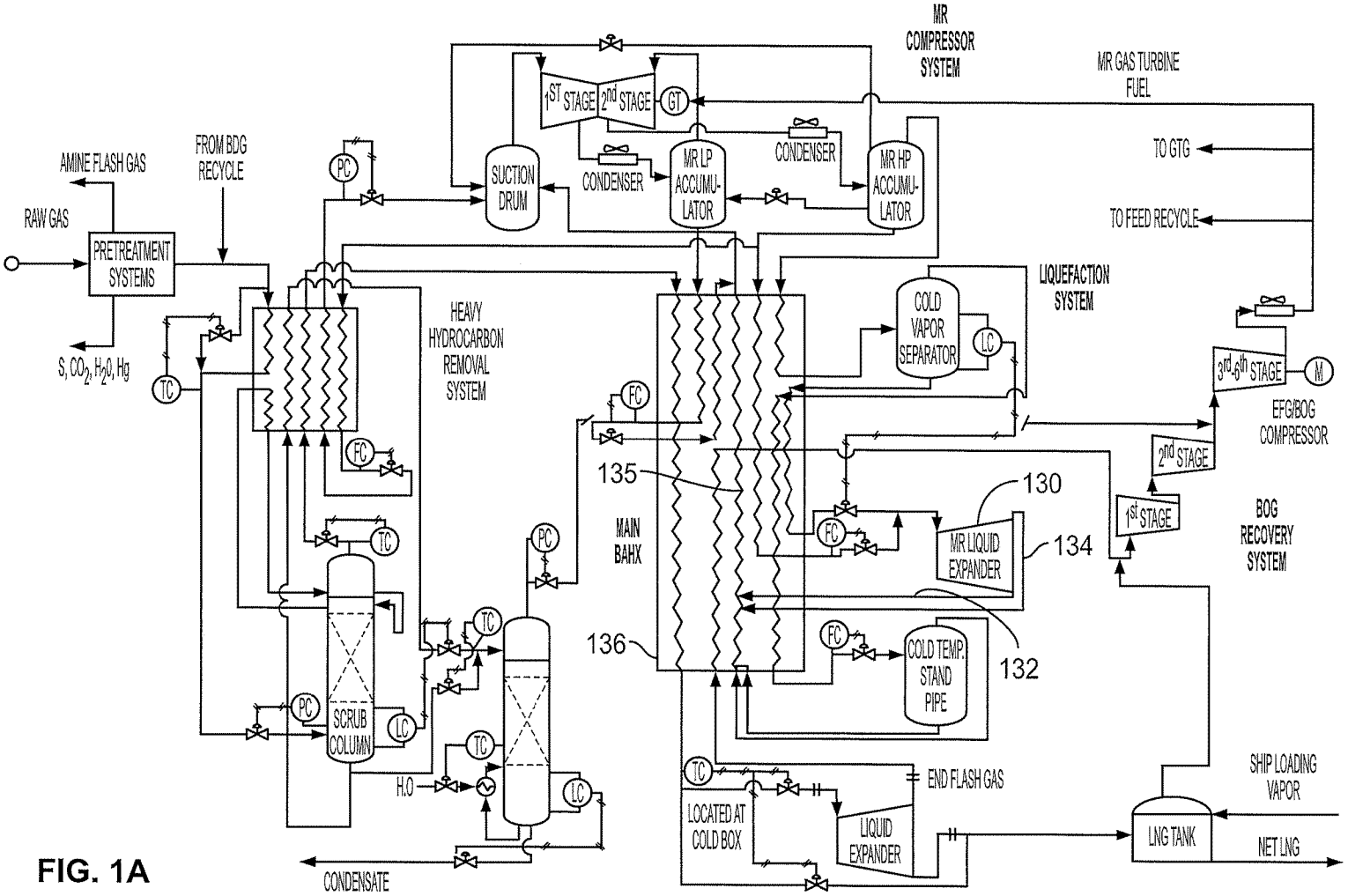
FIG. 1A is a process flow diagram and schematic illustrating a mixed refrigerant liquefaction system and method with a liquid expander with an integrated vapor/liquid separator on the high pressure mid-temperature mixed refrigerant stream.

Alternatively, with reference to FIG. 1A, a liquid expander separator 130 with integrated vapor/liquid separator/liquid pump (or the three components in series) can be used to eliminate the mid-temp stand pipe (128 of FIG. 1) and provide a separate liquid MR refrigeration stream 132 and a separate vapor MR refrigeration stream 134, which join the refrigeration stream 135 of the heat exchanger 136, to facilitate proper vapor/liquid distribution to the main heat exchanger 136 without the use of a standpipe separator. The liquid expander with integrated vapor/liquid separator/liquid pump 130 is used to increase pressure to the liquid stream, as required for the use of liquid via spray devices in the heat exchanger, and enhance distribution of the liquid within the heat exchanger. As an example only, the pressure and temperature of the liquid stream exiting the pump of 130 may be −147° F. and 78 psia. This reduces sensitivity to ship motion without increasing liquid volume (height) in the standpipe, as the standpipe is eliminated with this configuration.

The mid-temperature liquid expanders of FIG. 1 (120) and FIG. 1A (130) can be used either with or without the LNG liquid expander of FIG. 1 (24), FIG. 2 (36), FIG. 2A (58), FIG. 3 (77) and FIG. 4 (94) described above.

Figure 6:
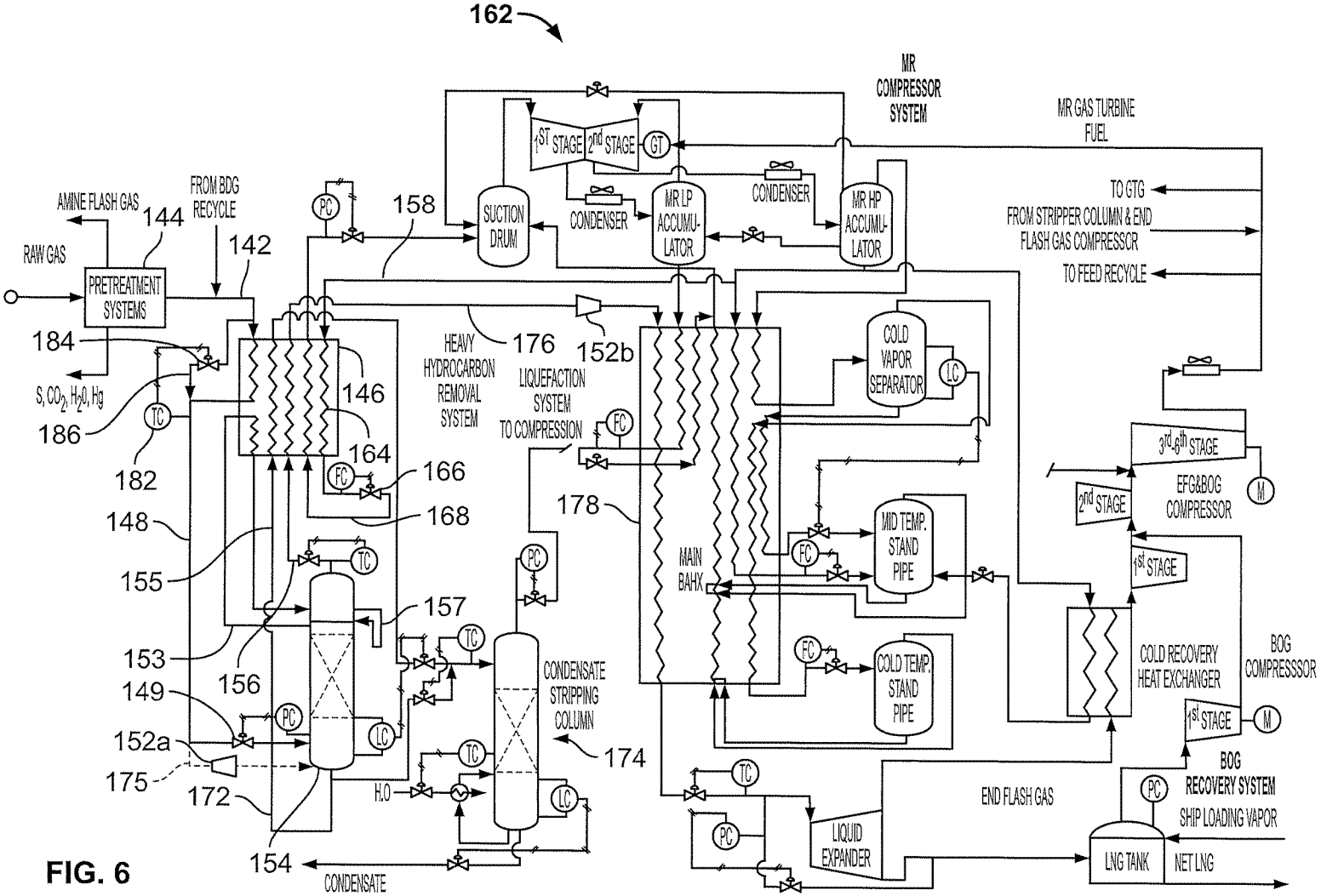
FIG. 6 is a process flow diagram and schematic illustrating a mixed refrigerant liquefaction system and method where the feed gas is first cooled with a heavy hydrocarbon removal heat exchanger and freezing components are removed from the feed gas.

Systems and methods for removing freezing components from the feed gas stream before liquefaction in the main heat exchanger will now be described with reference to FIGS. 6 and 7. While components of these systems are shown in the remaining figures, they are optional to the systems disclosed therein. Furthermore, the systems and methods for removing freezing components from the feed gas stream before liquefaction may be used with liquefaction systems other than those using a mixed refrigerant. As shown in FIG. 6, the feed gas stream 142, after any pretreatment systems 144, is cooled in a heavy hydrocarbon removal heat exchanger 146. The exit stream 148 is then reduced in pressure via a JT valve 149 or alternatively, as illustrated by line 175 in phantom, gas expander/compressor set 152*a*/152*b*, and fed to a scrub column or drum 154 or other scrub device. If the expander/compressor set 152*a*/152*b* is used, the gas expander 152*a* of line 148 drives the compressor 152*b* in line 175 to compress the gas that is to be liquefied in the main heat exchanger 178. As a result, the expander/compressor set 152*a*/152*b* reduces the energy requirements of the main heat exchanger both by reducing the pressure of the gas in line 148 and increasing the pressure of the gas in line 176.

As illustrated at 182 in FIG. 6 (and FIG. 7), a temperature sensor 182 is in communication with line 148, and controls bypass valve 184 of cooling bypass line 186. Temperature sensor 182 detects the temperature of the cooled gas stream 148 and compares it with the setting of the associated controller (not shown) for the desired temperature or temperature range for the stream entering the scrub column 154. If the temperature of the stream 148 is below a preset level, valve 184 opens to direct more fluid through bypass line 186. If the temperature of the stream 148 is above a preset level, valve 184 closes to direct more fluid through the heat exchanger 146. As an alternate, temperature sensor 182 may be located in the scrub column 154. As illustrated in FIG. 7, the bypass line 186 may alternatively enter the bottom of the scrub column 154 directly. The junction of bypass line 186 and line 148 illustrated in FIG. 6 is at a higher pressure than the bottom of the scrub column 154. As a result, the embodiment of FIG. 7 provides a lower outlet pressure for the bypass line 186 which provides for more accurate temperature control and permits a smaller (and more economical) bypass valve 184 to be used.

The refrigeration required to reflux the column 154 via reflux stream 155 is provided by the return vapor 156 from the column, optionally after a JT valve 226 (FIG. 7), which is warmed in the heat exchanger 146, and optionally, a mixed refrigerant (MR) stream, for example, 158 (FIG. 6) from the liquefaction compressor system (indicated in general at 162) that is also directed to the heat exchanger 146. The mixed refrigerant stream may come from any of the compressed MR stream of 162 or any combination of MR streams. The stream 153 exiting the scrub column, while preferably all vapor, contains components that liquefy at a higher temperature (as compared to the vapor stream 156 exiting the top of the column). As a result, the stream 155 entering the column 154 after passing through heat exchanger 146 is two-phase and the liquid component stream performs the reflux. The liquid component stream flows through a reflux liquid component passage that may include, as examples only, a reflux liquid component line that may be external (157) or internal to the scrub device or a downcomer or other internal liquid distribution device within the scrub device 154. As noted above, operation of the liquefaction compressor system may be as described in commonly owned U.S. Patent Application Publication No. 2011/0226008, U.S. patent Ser. No. 12/726,142, to Gushanas et al. After the MR is initially cooled in the heavy hydrocarbon heat exchanger via passage 164, it is flashed across a JT valve 166 to provide a cold mixed refrigerant stream 168 to the heavy hydrocarbon removal heat exchanger.

The temperature of the mixed refrigerant can be controlled by controlling the boiling pressure of the mixed refrigerant.

The components removed from the bottom of the scrub column 154 via stream 172 are returned to the heat exchanger 146 to recover refrigeration and then sent to additional separation steps such as a condensate stripping system, indicated in general at 174 or sent to fuel or other disposal methods.

The feed gas stream 176 exiting the heat exchanger 146, with freezing components removed, is then sent to the main liquefaction heat exchanger 178, or in the case of incorporating an expander/compressor, is first compressed, then sent to the main heat exchanger 178.

An alternative system and method for removing freezing components from a feed gas stream before liquefaction in the main heat exchanger 208 will now be described with reference to FIG. 7. It is to be understood that FIG. 7 shows only one of many possible options for the liquefaction system, indicated in general at 209. The system and method of removing freezing components described below with reference to FIG. 7 can be utilized with any other liquefaction system or method (including, but not limited to, those disclosed in FIGS. 1-6) and integrated within the liquefaction system and method in some cases.

Figure 7:
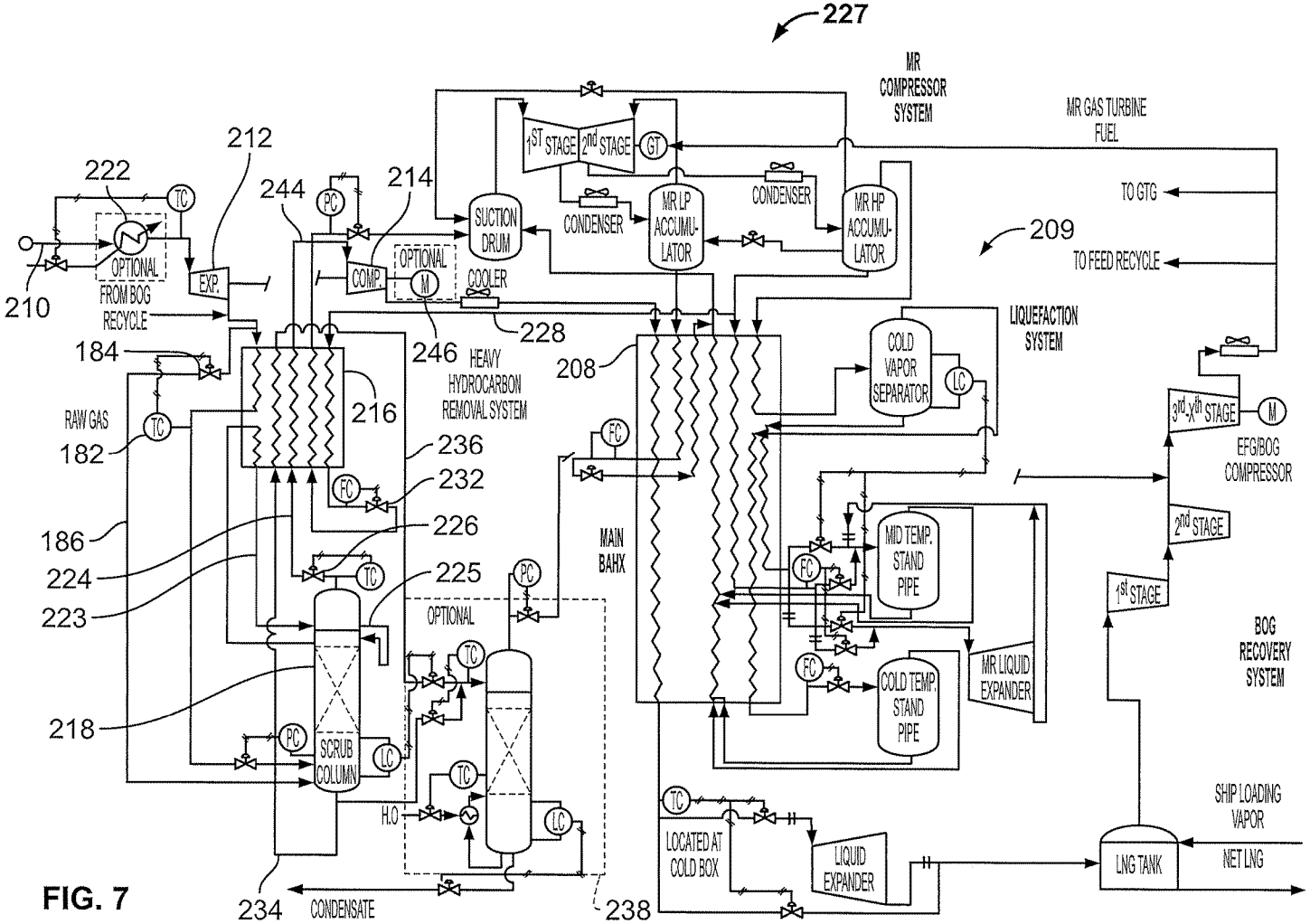
FIG. 7 is a process flow diagram and schematic illustrating an alternative mixed refrigerant liquefaction system and method where the feed gas is first cooled with a heavy hydrocarbon removal heat exchanger and freezing components are removed from the feed gas.

In the system and method of FIG. 7, the feed gas, which flows through line 210, is reduced in pressure with an expander 212, which is connected to a compressor 214 or other loading device such as a brake or generator. The gas is cooled by the expansion process and then further cooled in a heavy hydrocarbon removal heat exchanger 216, then fed to a scrub column or separation drum 218 or other scrub device for the separation of the freezing components from the feed gas.

Optionally, the feed gas may be heated before the expander 212 via a heating device 222 to increase the energy recovered by the expander, and therefore, provide additional compression power. The heating device may be a heat exchanger or any other heating device known in the art.

As in the embodiment of FIG. 6, the refrigeration required to reflux the scrub column via reflux stream 223 is provided by the return vapor 224 from the column, which is further reduced in pressure and temperature via a JT valve 226 prior to being warmed in the heat exchanger 216, and optionally mixed refrigerant (MR) via for example line 228 from the liquefaction compressor system, indicated in general at 227. The mixed refrigerant stream may come from any of the compressed MR stream of 227 or any combination of MR streams. The stream 223 entering the column 218 is two-phase and the liquid component stream performs the reflux. The liquid component stream flows through a reflux liquid component passage that may include, as examples only, a reflux liquid component line that may be external (225) or internal to the scrub device or a downcomer or other internal liquid distribution device within the scrub device 218. As noted above, operation of the liquefaction compressor system may be as described in commonly owned U.S. Patent Application Publication No. 2011/0226008, U.S. patent application Ser. No. 12/726,142, to Gushanas et al. After the mixed refrigerant is cooled in the heavy hydrocarbon removal heat exchanger, it is flashed across a JT valve 232 to provide the cold mixed refrigerant to the heavy hydrocarbon removal heat exchanger.

The temperature of the mixed refrigerant can be controlled by controlling the boiling pressure of the mixed refrigerant.

The removed components, after traveling through a freezing components outlet in the scrub column bottom, may be returned to the heat exchanger 216 to recover cold refrigeration via line 234 and then sent to additional separation steps such as a condensate stripping system 238 via line 236 as shown in FIG. 7 or sent to fuel or other disposal methods with or without recovering cold refrigeration.

The feed gas stream, with freezing components removed, 244 is then sent to the main heat exchanger 208 of the liquefaction system, after being compressed in the compressor 214 of the expander/compressor. If additional feed gas compression is required, the expander/compressor may be replaced with a compander which can be fitted with the expander, additional compression stages if needed and another driver such as an electric motor 246 or steam turbine, etc. Another option is to simply add a booster compressor in series with the compressor driven by the expander. In all cases, the increased feed gas pressure lowers the energy required for liquefaction and improves liquefaction efficiency, which in turn, can increase liquefaction capacity.

While the preferred embodiments of the invention have been shown and described, it will be apparent to those skilled in the art that changes and modifications may be made therein without departing from the spirit of the invention, the scope of which is defined by the appended claims.

What is claimed is:

1. A system for liquefying a gas comprising:

a. a liquefaction heat exchanger having a warm end including a feed gas inlet and a cold end including a liquefied gas outlet with a liquefying passage positioned therebetween, where the feed gas inlet is adapted to receive a feed gas, said liquefaction heat exchanger also including a primary refrigeration passage;

b. a mixed refrigerant compressor system configured to provide refrigerant to the primary refrigeration passage;

c. an expander separator in communication with the liquefied gas outlet of the liquefaction heat exchanger;

d. a cold gas line in fluid communication with the expander separator;

e. a cold recovery heat exchanger having a vapor passage in communication with the cold gas line and a liquid passage in communication with the primary refrigeration passage, where the vapor passage is configured to receive a cold vapor from the cold gas line;

f. said mixed refrigerant compressor system including a separation device having at least one separation device liquid outlet and a separation device vapor outlet;

g. said at least one separation device liquid outlet configured to direct a first portion of liquid refrigerant to the liquid passage of the cold recovery heat exchanger and a second portion of liquid refrigerant to the liquefaction heat exchanger;

h. said cold recovery heat exchanger configured to cool the first portion of liquid refrigerant in the liquid passage using the cold vapor in the vapor passage and direct the cooled first portion of liquid refrigerant to the primary refrigeration passage; and i. a junction that is external to the primary refrigeration passage and configured to receive and combine the cooled first portion of liquid refrigerant and the second portion of liquid refrigerant, said junction including a middle temperature standpipe configured to receive the cooled first portion of liquid refrigerant and the second portion of liquid refrigerant or the combined cooled first portion of liquid refrigerant and the second portion of liquid refrigerant and having a standpipe vapor outlet in communication with the primary refrigeration passage and a standpipe liquid outlet in communication with the primary refrigeration passage of the liquefaction heat exchanger so that the combined cooled first portion of liquid refrigerant and second portion of liquid refrigerant are provided to the primary refrigeration passage through the standpipe vapor outlet and the standpipe liquid.

2. The system of claim 1 wherein the expander separator includes a liquid product outlet and an end flash gas outlet and wherein cold gas line is in communication with the end flash gas outlet so as to provide end flash gas to the vapor passage of the cold recovery heat exchanger.

3. The system of claim 2 wherein said liquefaction heat exchanger includes an end flash gas passage also in communication with the end flash gas outlet of the expander separator.

4. The system of claim 2 further comprising a liquid product storage tank in communication with the liquid product outlet of the expander separator and wherein the cold recovery heat exchanger includes a second vapor passage, said liquid product storage tank configured to create product end flash gas from a stream of liquid product entering the storage tank from the liquid product outlet, said liquid product storage tank having a headspace in communication with the second vapor passage so that product end flash gas is provided to the second vapor passage of the cold recovery heat exchanger.

5. The system of claim 2 further comprising a liquid product storage tank in communication with the liquid product outlet of the expander separator, said liquid product storage tank configured to create product end flash gas from a stream of liquid product entering the storage tank from the liquid product outlet, said liquid product storage tank having a headspace also in communication with the vapor passage of the cold recovery heat exchanger so that product end flash gas from the headspace of the product storage tank and end flash gas from the end flash gas outlet of the expander separator are provided to the vapor passage of the cold recovery heat exchanger.

6. The system of claim 1 wherein the expander separator includes a liquid product outlet and further comprising a liquid product storage tank in communication with the liquid product outlet, said liquid product storage tank configured to create product end flash gas from a stream of liquid product entering the storage tank from the liquid product outlet, said liquid product storage tank having a headspace in communication with the cold gas line so that product end flash gas is provided to the vapor passage of the cold recovery heat exchanger.

7. The system of claim 6 further comprising a compressor positioned within the cold gas line.

8. The system of claim 1 wherein the outlet of the vapor passage of the cold recovery heat exchanger is in communication with a compressor.

9. The system of claim 1 wherein the expander separator is a liquid expander with an integrated vapor/liquid separator.

10. The system of claim 1 wherein the expander separator include a liquid expander in series with a vapor/liquid separator.

11. The system of claim 1 wherein the primary refrigeration passage of the liquefaction heat exchanger includes a first inlet that is configured to receive a stream of refrigerant from the separation device vapor outlet and a second inlet that is configured to receive a stream of refrigerant from the liquid passage of the cold recovery heat exchanger where the stream of refrigerant from the liquid passage of the cold recovery heat exchanger is separate from the stream of refrigerant from the separation device vapor outlet when the stream of refrigerant from the liquid passage of the cold recovery heat exchanger flows through the second inlet.

12. The system of claim 1 wherein the junction is configured to combine the first and second portions of liquid refrigerant prior to entry into the liquefaction heat exchanger.

13. The system of claim 1 wherein the at least one separation device liquid outlet includes a split having an inlet connected to the separation device liquid outlet and outlets configured to direct the first portion of liquid refrigerant to the liquid passage of the cold recovery heat exchanger and the second portion of liquid refrigerant to the liquefaction heat exchanger.

14. The system of claim 13 wherein the liquefaction heat exchanger includes a liquid refrigerant cooling passage configured so that the second portion of liquid refrigerant from the at least one separation device liquid outlet is directed to the liquid refrigerant cooling passage of the liquefaction heat exchanger prior to being directed to the junction.

15. The system of claim 1 wherein the liquefaction heat exchanger includes a liquid refrigerant cooling passage configured so that the second portion of liquid refrigerant from the at least one separation device liquid outlet is directed to the liquid refrigerant cooling passage of the liquefaction heat exchanger prior to being directed to the junction.

* * * * *